United States Patent [19]

White et al.

[11] Patent Number: 4,650,133

[45] Date of Patent: Mar. 17, 1987

[54] WINDER APPARATUS AND METHOD

[76] Inventors: Frances H. White; Eugene F. White, both of 310 Macedonia Church Rd., Monroe, N.C. 28110

[21] Appl. No.: 871,430

[22] PCT Filed: Jul. 2, 1985

[86] PCT No.: PCT/US85/01259

§ 371 Date: Apr. 28, 1986

§ 102(e) Date: Apr. 28, 1986

[87] PCT Pub. No.: WO86/00605

PCT Pub. Date: Jan. 30, 1986

[51] Int. Cl.[4] ..... B65H 59/38

[52] U.S. Cl. ..... 242/45; 242/36

[58] Field of Search ..... 242/45, 36, 37 R, 38, 242/39, 18 R, 147 R, 155 R, 155 M, 75.5, 75.51, 75.52

[56] References Cited

U.S. PATENT DOCUMENTS

| | | | |
|---|---|---|---|
| 3,514,615 | 5/1970 | Noiles et al. | 242/36 X |
| 3,536,272 | 10/1970 | Ueyama | 242/45 |
| 3,858,416 | 1/1975 | White et al. | 242/45 X |
| 3,862,723 | 1/1975 | Bonikowski | 242/45 |
| 4,447,955 | 5/1984 | Stutz et al. | 242/36 X |

FOREIGN PATENT DOCUMENTS

| | | | |
|---|---|---|---|
| 1400405 | 7/1975 | United Kingdom | 242/45 |

*Primary Examiner*—Stanley N. Gilreath

*Attorney, Agent, or Firm*—Daniel E. McConnell

[57] ABSTRACT

A method of and apparatus for winding a strand of material such as textile yarn in which a single strand is advanced from a supply package by a variable speed electrical drive associated with a takeup package while being guided from the supply package along a predetermined path of travel toward the takeup package, and in which a single strand of material advancing along the path is engaged by an electrical signal generating electrically controllable tensioning device which generates an electrical signal indicative of strand advancement while imposing controllable tension on the engaged strand material, a drive signal is derived from the generated electrical signal and applied to the electrical drive so as to controllably vary the speed thereof in response to signals indicative of strand advancement, and a tension signal is derived from the generated electrical signal and applied to the tensioning device so as to controllably vary the tension imposed thereby on the engaged strand in response to signals indicative of strand advancement.

23 Claims, 3 Drawing Figures

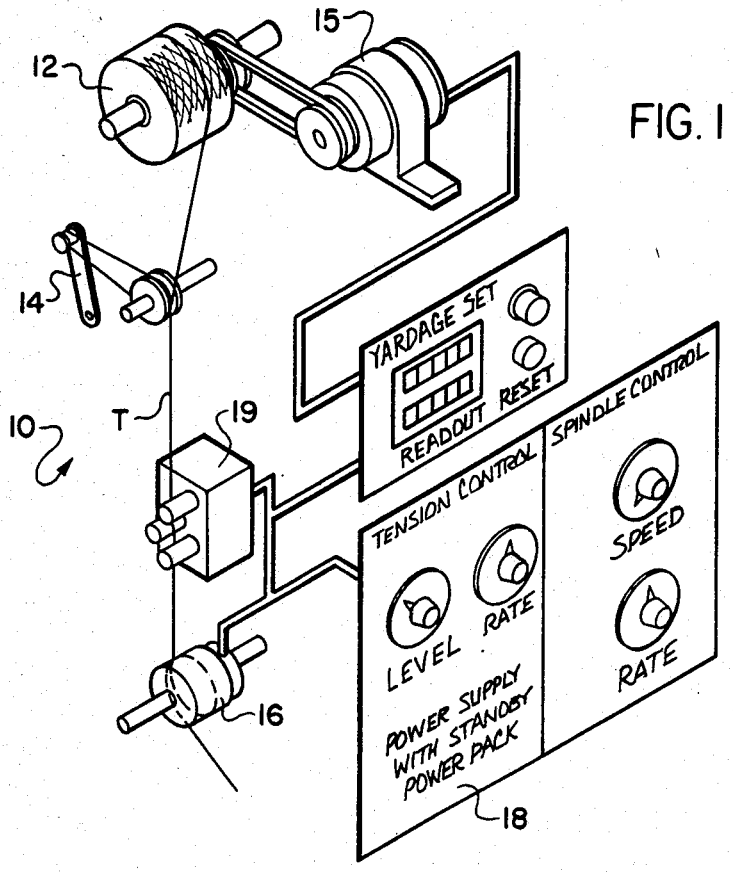
FIG. 1
FIG. 3
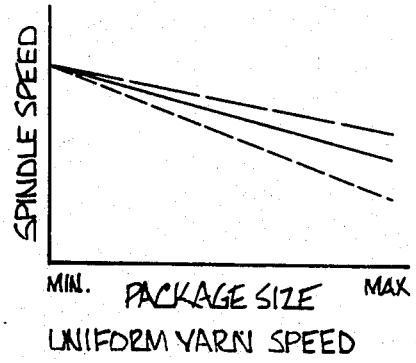
UNIFORM YARN SPEED
FIG. 2
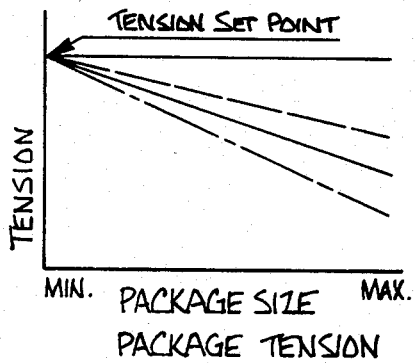
PACKAGE TENSION

WINDER APPARATUS AND METHOD

FIELD AND BACKGROUND OF INVENTION

This invention relates to precision winders such as are used in the repackaging of strand materials such as textile thread and yarns.

In certain manufacturing processes, such as the manufacture of sewing thread, it is conventional to repackage strands by an operation known as winding, performed on apparatus known as winders. Certain winders, capable of high speed and controlled winding, are known as precision winders. An early example of a precision winder is the Leesona Model 50, shown for example in Bell U.S. Pat. No. 2,608,355. A more recent example is the Ott NGS 10, manufactured by A. Ott of Kempten, Germany. More detailed information regarding such apparatus and the methods of operation inherent in them can be obtained from the aforementioned Patent and from industry sources such as trade publications. Generally speaking, such winders may be characterized as having provision for one or more supply packages of strand material, a take-up package about which strand material is to be wound, and guide means for guiding strand material from a supply package to the take-up package.

One of the important economic justifications for the use of precision winders of the types described lies in the speed of operation of the winders and the capability of the winders to achieve desired package characteristics. While such apparatus and methods as have been known heretofore have achieved acceptance within the industries where they are used, precision winders of the types mentioned above encounter certain problems. In particular, such winders encounter limitations on the speed of strand movement and on the coordination of tension imposed on the strand during winding. Heretofore, the usual design comprises with respect to speed have been to select a limiting strand speed or velocity at the extreme capability of the state of the art and then design the drive for the take-up package to operate at a constant rotational speed calculated to provide the limiting strand speed at the greatest anticipated diameter of the take-up package. The usual design with respect to strand tension has been to attempt to achieve a uniform strand tension throughout winding. As a result of these choices, strand speed or velocity during the early stages of a package build, or while the diameter of the take-up package is relatively small, is usually well below the limiting speed. Further, attempts to maintain a uniform strand tension throughout package building usually results in a "hard" package in which the outer layers of strand material are so tightly wound that excessive compressive forces are exerted on the inner layers and of any core about which the package is wound. In some instances, such forces have been known to crush the package cores, and to otheriwse interfere with unwinding of the strand material.

BRIEF DESCRIPTION OF THE INVENTION

With the foregoing discussion in mind, it is an object of this invention to accomplish high speed precision winding of strand material such as textile yarn or thread in accordance with improved methods and through the use of an improved apparatus which achieves high productivity while avoiding "hard" packages. In realizing this object of the invention, the rotational speed of a drive for advancing the strand material and the tensioning force exerted by a tensioning device are correlated to the velocity and advancement of the strand material being wound.

A further object of this invention is to monitor the speed or velocity of an advancing strand, generating an electrical signal indicative of such strand movement, and control the speed of winding and the tension imposed on the strand by an electrical closed loop feedback system responsive to such a signal. In realizing this object of the present invention, a drive signal and a tension signal are derived from the signal indicative of strand movement, with the derived signals being applied to respective ones of the drive for advancing the strand and the tensioning device which forms a portion of the monitoring arrangement.

Yet a further object of this invention is to reduce the speed of a winding drive electrical motor and the tension imposed by a winding device in predetermined relation to the advancement of the strand being wound. In realizing this object of the invention, the reductions may be in accordance with any selected rate of correlation, including non-linear rates where desired, in order that optimal winding speed and package characteristics be obtained.

BRIEF DESCRIPTIONS OF DRAWINGS

Some of the objects of the invention having been stated, other objects will appear as the description proceeds, when taken in connection with the accompanying drawings, in which:

FIG. 1 is a schematic elevation view of an apparatus constructed and operating in accordance with this invention;

FIG. 2 is a graphic representation of possible correlations of package size to tension imposed; and FIG. 3 is a graphic representation similar to FIG. 2 and illustrating possible correlations between package size and winding drive speed.

DETAILED DESCRIPTION OF INVENTION

While the present invention will be described more fully hereinafter with reference to the accompanying drawings, in which a preferred embodiment of the present invention is shown, it is to be understood at the outset of the description which follows that persons of skill in the appropriate arts may modify the invention here described while still achieving the favorable results of this invention. Accordingly, the description which follows is to be understood as being a broad, teaching disclosure directed to persons of skill in the appropriate arts, and not as limiting upon the present invention.

Referring now more particularly to FIG. 1, where an apparatus generally indicated at 10 is shown, the apparatus will be recognized as being an apparatus for winding a strand of material such as textile yarn or thread T which has supply means for mounting one or more supply packages (not shown) of strand material, takeup means for mounting a takeup package 12 for the strand material T, and guide means including a traverse motion compensator 14 for guiding the strand material from the supply package along a predetermined path of travel toward the takeup package. In accordance with this invention, the apparatus 10 has improvements which include variable speed electrical drive means 15 operatively associated with the takeup means for driving the takeup packet 12 and thereby for advancing the strand material from the supply package toward the takeup package for winding of the strand thereabout, tensioning device means 16 engaging the strand material advancing along the path for generating an electrical signal indicative of strand velocity and for imposing tension on the engaged strand material, and electrical signal processing means (located behind the panel illustrated at 18) electrically connected to said strand engaging means and to said electrical drive means for receiving electrical signals indicative of strand velocity and for responding thereto by controllably varying the speed of said electrical drive means and the tension imposed by said strand engaging means in response to such signals indicative of strand velocity.

In the apparatus 10 of this invention, and as described more fully hereinafter, the drive 15 preferably is a variable speed electrical drive motor operatively associated with a spindle of the takeup means for driving the takeup package 12 mounted thereon and thereby for advancing the strand material from the supply package toward the takeup package for winding of the strand thereabout. The tensioning device 16 preferably is a combined device including a signal generating portion for generating an electrical signal indicative of strand advancement and an electrically controllable brake portion for imposing an electrically controllable variable tension on the engaged strand material. the device 16, to be described more fully hereinafter, is mounted adjacent the path of travel of the strand and has a sheave engaging the strand material T. The electrical signal processing means is electrically connected to the strand engaging means 16 and to the electrical drive motor 15 for receiving and responding to electrical signals indicative of strand advancement and for deriving a drive signal applied to the motor so as to controllably vary the speed thereof in response to signals indicative of strand advancement and for deriving a tension signal applied to the tensioning device so as to controllably vary the tension imposed thereby on the engaged strand in response to signals indicative of strand advancement.

The device 16 preferably is a device which has a rotatable shaft on which a sheave or pulley capable of gripping engagement with strand material is mounted. The force required to rotate the shaft is electrically controllable by the provision of an electrically controllable brake in the device. Such a brake may be any of several known types, including hysterisis and magnetic particle brakes, and the specific choice may be left to the skill of knowledgable persons learning of this disclosure. Rotation of the shaft results in the generation of signals indicative of such rotation by the provision of a signal generating means in the device. Such a deivce may be any of several known types, including transparent disks used with photoelectric sensors or magnetic disks used with Hall effect sensors, and the specific choice may be left to the skill of knowledgable persons learning of this disclosure. Inasmuch as the force required to rotate the shaft is derived from the winding of the strand T, braking force exerted on the shaft of the device 16 will result in tension appearing in the strand. Further, due to the gripping engagement of the sheave with the strand and the known diameter of the sheave, a known correlation exists between rotation of the shaft and advancement of known lengths of strand material.

In accordance with this invention, these factors are used to advantage in the electrical signal processing means and in controlling the operation of the apparatus 10 so as to enhance the operation thereof. More particularly, the signal processing means receives signals from the strand engaging tensioning device means 16 and from a tension sensor 19 which engages the strand T at a location along the path of travel of the strand between the device and the takeup package 12. The tension sensor may be any known type of device which generates an electrical signal indicative of the degree of tension in a moving strand, such as an arrangement of three pins about which the strand is trained, with one pin being biased by a spring or the like and with means such as a Hall effect device arranged to be responsive to the pin position. The signal processing emans, receiving signals indicative of the rotation of the shaft of the tensioning device 16 and the degree of tension present in the strand, is provided in accordance with this invention with the capability of determining the velocity or speed of movement of the strand being wound, the length of strand material which has been advanced to the takeup package, and the tension present in the advancing strand material. Further, the signal processing means is provided with the capability, in accordance with this invention, of controlling the tension imposed by the tensioning device 16 and the speed at which strand material is drawn by the drive motor 15 so as to control the efficiency of winding by the apparatus 10 and the characteristics of the wound package 12. As a corollary, the signal processing means has the capability of monitoring certain machine operation characteristics and responding by interrupting operation of the winder as may be necessary or appropriate upon a package of predetermined size having been wound or the strand material becoming broken or run out.

In use, strand material is wound in accordance with a method in which the speed of and tension in the advancing strand are sensed and, by a closed loop control established through the signal processing means, the tension imposed and drive speed of the winder are controlled to optimize the operation of the winder. Such optimization may include decreasing the tension imposed on the strand material in a predetermined correlation to the length of strand material advanced, which is indicative of the size of the takeup package. Such a correlation may be linear, as indicated in the graph of FIG. 2, or non-linear. In either instance, the slope of the variation may vary by adjustment of the operation of the signal processing means so as to achieve desired characteristics for the wound package. That is, if a particular strand material has a demonstrated tendency to create a "hard package" if wound at a constant tension throughout the formation of a package, then the tension may be gradually decreased during package winding so that the outer layers of the package are "softer". As indicated in FIG. 2 by dashed lines, such variations in rates may provide varying slopes in a line relating strand tension to package size.

Similarly, the spindle speed of the winder, or the rotational speed of the drive motor 15, may vary in a predetermined correlation to the length of strand material advanced as suggested in the graph of FIG. 3. By accomplishing such variation, the package may be wound during the initial stages of package formation at strand velocities more nearly approaching the practical maximums, while never exceeding those practical maximums during package formation. In achieving this result, the efficiency of the winder 10 is significantly enhanced and productivity improved.

As indicated in FIG. 1, the signal processing means preferably is provided with means for varying both the level of tension imposed and the rate of change of that level with strand length advanced, and with means for varying both the speed of the drive means 15 and the rate of change of that speed with strand length advanced. These results may be accomplished with a number of forms or types of digital microprocessors capable of receiving and processing electrical signals of the types described above as being generated by the tensioning device 16 and the tension sensor 19. Persons familiar with the selection and design of digital microprocessor circuits will be enabled by this discussion to select conventionally available circuitry to accomplish the functions of monitoring the signals from the tensioning device 16 and tension sensor 19 and developing control signals to be supplied to the drive means 15 and tensioning device 16 in such a manner as to accomplish the closed loop control envisioned for the present invention.

By way of an illustrative example, microprocessors of the types known as 8013, 8015 and Z-80 may be programmed using machine language or higher level languages such as Basic to respond to digital signals received from the tensioning device 16 and tension sensor 19 by processing such signals and developing control signals as described above. Specific programs will vary with the microprocessor chosen, the winder environment, and the desired characteristics of winder operation, all as discussed more fully hereinafter. For that reason, no detailed program listing is here given, it being considered that a knowledgable programmer familiar with any of the aforementioned microprocessors will be able, from the present disclosure, to prepare such a listing and further that inclusion of an illustration of such a listing here would occupy an excessive number of pages of the present specification.

It may be the purpose of this invention in a selected winder environment to advance yarn at the highest possible speed while properly handling the yarn with regard to possible breakage, package characteristics, etc. For purposes of the present illustration only, it may be considered that, in a winder with a traverse mechanism, desirable speeds may be 600 yards per minute or 800 yards per minute or 1000 yards per minute. Thus, one control factor may be selected. Assuming further that a speed of 800 yards per minute has been selected and that the drive means of the specific winder under consideration will not exceed 5000 revolutions per minute for the takeup package, then it may be determined whether the initial yarn speed at the start of winding will be above or below the desired speed. If the initial yarn speed is above the desired speed with the drive operating at the speed of which it is capable, then winding must being with the drive operated at a reduced speed. If the initial yarn speed is below the desired speed, then the drive may be operated at the maximum speed of which it is capable until such time as the yarn speed reaches 800 yards per minute.

In either event, upon the yarn speed reaching the desired rate, the drive speed is then reduced so as to maintain the yarn speed at the desired rate. Thus as package size increases, spindle speed slows as shown in FIG. 3. The programs necessary to accomplish the function thus described would correlate the yarn speed to drive speed and maintain yarn speed either constant or changing in accordance with a predetermined profile or curve.

At the same time, or separately is deemed appropriate, control over the hardness of a yarn package may be established and maintained by responding to sensed tension in the yarn by deriving a tension control signal. By way of example only, a desired package characteristic may be achieved by beginning winding with a yarn tension of 40 grams for the layers adjacent the package core and ending with a tension of 12 grams for the outermost layers of a package containing 25,000 yards of yarn. In accordance with the present invention, the tension control signal may be incrementally stepped through a series of 1000 steps so as to accomplish such a reduction gradually and, where the steps are of equal increments, linearly as shown in FIG. 2. Where the reduction is to be non-linear, then the incremental steps may be unequal by amounts calculated in accordance with any desired curve configuration.

As will be appreciated by the competent programmer, a program may be written which will provide appropriate loops for sensing signals of yarn speed and performing such calculations as may be necessary to determining speed and length of yarn or package size, comparing package size to any predetermined table of drive speeds and yarn tensions, comparing yarn speed with any predetermined table of desired speeds, sensing signals of yarn tension, comparing yarn tension to any predetermined table of yarn tensions, and deriving control signals for the drive and tension device. In performing comparisons, such a program may operate with tables which are in part derived from manually set inputs such as those illustrated in FIG. 1 and in part derived from other computations or comparisons performed as part of the program steps. It is contemplated that the present invention will encompass all such manners in which such a program may function.

The control accomplished may also be operative to select package size for the takeup package 12. That is, inasmuch as the length of strand material advanced is determined by the electrical signal processing means, provision may be made (as shown in FIG. 1) for determination that a predetermined condition, such as the advancement of a predetermined length of strand material, has been met and thereupon interrupt further winding. Similarly, the cessation of rotation of the sheave of the strand engaging means 16 or a signal that no tension is present at the tension sensor 19 is indicative that the strand material has broken or run out and cannot be wound up. In either such event, further winding is interrupted in a manner similar to the function known as a "stop motion".

In the drawings and specifications there has been set forth a preferred embodiment of the invention and, although specific terms are used, the description thus given uses terminology in a generic and descriptive sense only and not for purposes of limitation.

What is claimed is:

1. In an apparatus for winding a strand of material such as textile yarn which has supply means for mounting a supply package of strand material, takeup means for mounting a takeup package for the strand material, and guide means for guiding the strand material from the supply package along a predetermined path of travel toward the takeup package, an improvement comprising:

variable speed electrical drive means operatively associated with the takeup means for driving the takeup package and thereby for advancing the strand material from the supply package toward the takeup package for winding of the strand thereabout, means engaging the strand material advancing along the path for generating an electrical signal indicative of strand velocity and for imposing tension on the engaged strand material, and electrical signal processing means electrically connected to said strand engaging means and to said electrical drive means for receiving electrical signals indicative of strand velocity and for responding thereto by controllably varying the speed of said electrical drive means and the tension imposed by said strand engaging means in response to such signals indicative of strand velocity.

2. In an apparatus for winding a strand of material such as textile yarn which has supply means for mounting a supply package of a strand material, takeup means for mounting a takeup package for the strand material, and guide means for guiding the strand material drawn from the supply package along a predetermined path of travel toward the takeup package, an improvement comprising:

variable speed electrical drive means operatively associated with the takeup means for driving the takeup package and thereby for advancing the strand material from the supply package toward the takeup package for winding of the strand thereabout, means engaging the strand material advancing along the path for generating an electrical signal indicative of strand advancement and for imposing an electrically controllable variable tension on the engaged strand material, and electrical signal processing means electrically connected to said strand engaging means and to said electrical drive means for receiving and responding to electrical signals indicative of strand advancement and for deriving a drive signal applied to said electrical drive means so as to controllably vary the speed thereof in response to signals indicative of strand advancement and for deriving a tension signal applied to said strand engaging means so as to controllably vary the tension imposed thereby on the engaged strand in response to signals indicative of strand advancement.

3. Apparatus according to one of claim 1 or claim 2 wherein said electrical signal processing means is responsive to said received signals for determining the wound length of strand material and further wherein said electrical signal processing means functions to vary tension imposed by said strand engaging means as the determined length of strand material increases.

4. Apparatus according to claim 3 wherein said electrical signal processing means functions to decrease tension imposed by said strand engaging means as the determined length of strand material increases.

5. Apparatus according to one of claim 1 or claim 2 wherein said electrical signal processing means is responsive to said received signals for determining the wound length of strand material and further wherein said electrical signal processing means functions to vary the speed of said drive means as the determined length of strand material increases.

6. Apparatus according to claim 5 wherein said electrical signal processing means functions to decrease the speed of said drive means as the determined length of strand material increases.

7. Apparatus according to one of claim 1 or claim 2 wherein said electrical signal processing means is responsive to said received signals for determining the wound length of strand material and further wherein said electrical signal processing means functions to vary tension imposed by said strand engaging means and to vary the speed of said drive means as the determined length of strand material increases.

8. Apparatus according to claim 7 wherein said electrical signal processing means functions to decrease tension imposed by said strand engaging means and the speed of said drive means as the determined length of strand material increases.

9. Apparatus according to one of claim 1 or claim 2 wherein said electrical signal processing means is operatively connected to said drive means for controllably interrupting continued advancement of the strand material along the predetermined path upon occurrence of one of an event of completion of winding of a predetermined length of strand material and an event of interruption in winding.

10. Apparatus according to claim 9 wherein said electrical signal processing means is responsive to said received signals for determining the wound length of strand material and further wherein said electrical signal processing means comprises length limit means for interrupting continued advancement of strand material along the path upon advancement of a predetermined length of material.

11. Apparatus according to claim 9 wherein said electrical signal processing means is responsive to said received signals for determining the absence of strand material and further wherein said electrical signal processing means comprises stop motion means for interrupting operation of the apparatus in the absence of strand material.

12. In an apparatus for winding a strand of material such as textile yarn which has supply means for mounting a supply package of strand material, takeup means for mounting a takeup package for the strand material, and guide means for guiding the strand material drawn from the supply package along a predetermined path of travel toward the takeup package, an improvement comprising:

variable speed electrical drive means operatively associated with the takeup means for driving the takeup package and thereby for advancing the strand material from the supply package toward the takeup package for winding of the strand thereabout, means engaging the strand material advancing along the path for generating an electrical signal indicative of strand advancement and for imposing an electrically controllable variable tension on the engaged strand material, and electrical signal processing means electrically connected to said strand engaging means and to said electrical drive means for receiving and responding to electrical signals indicative of strand advancement and for deriving a drive signal applied to said electrical drive means so as to controllably decrease the speed thereof in response to signals indicative of advancement of increasing length of strand material and for deriving a tension signal applied to said strand engaging means so as to controllably decrease the tension imposed thereby on the engaged strand in response to signals indicative of advancement of increasing length of strand material.

13. In a method of winding a strand of material such as textile yarn in which a strand is advanced by an electrical drive from a supply package to a takeup package while being guided from the supply package along a predetermined path of travel toward the takeup package, an improvement comprising:

engaging the strand advancing along the path with a signal generating controllable tensioning device and generating an electrical signal indicative of strand velocity while imposing controllable tension on the engaged strand, and responding to the electrical signal indicative of strand velocity and deriving signals applied to the electrical drive for controllably varying the speed of advancement of the strand and to the tensioning device for controllably varying the tension imposed on the strand.

14. In a method of winding a strand of material such as textile yarn in which a strand is advanced from a supply package by a variable speed electrical drive associated with a takeup package while being guided from the supply package along a predetermined path of travel toward the takeup package, an improvement comprising:

engaging the strand material advancing along the path with a electrical signal generating electrically controllable tensioning device and generating an electrical signal indicative of strand advancement while imposing controllable tension on the engaged strand material, deriving from the generated electrical signal a drive signal and applying the derived drive signal to the electrical drive so as to controllably vary the speed thereof in response to signals indicative of strand advancement, and deriving from the generated electrical signal a tension signal and applying the derived tension signal to the tensioning device so as to controllably vary the tension imposed thereby on the engaged strand in response to signals indicative of strand advancement.

15. A method according to one of claim 13 or claim 14 wherein the step of deriving a signal comprises determining the length of strand material advanced and generating an electrical signal which functions to vary tension imposed by the tensioning device as the determined length of strand material increases.

16. A method according to claim 15 wherein the step of deriving a signal further comprises generating an electrical signal which functions to decrease tension imposed by the tensioning device as the determined length of strand material increases.

17. A method according to one of claim 13 or claim 14 wherein the step of deriving a signal comprises determining the length of strand material advanced and generating an electrical signal which functions to vary the speed of the electrical drive as the determined length of strand material increases.

18. A method according to claim 17 wherein the step of deriving a signal further comprises generating an electrical signal which functions to decrease the speed of the electrical drive as the determined length of strand material increases.

19. A method according to one of claim 13 or claim 14 wherein the step of deriving a signal comprises determining the length of strand material advanced and generating electrical signals which respectively function to vary the speed of the electrical driven and to vary tension imposed by the tensioning device as the determined length of strand material increases.

20. A method according to claim 19 wherein the step of deriving a signal further comprises generating electrical signals which respectively function to decrease the speed of the electrical drive and to decrease tension imposed by the tensioning device as the determined length of strand material increases.

21. A method according to one of claim 13 or claim 14 further comprising controllably interrupting continued advancement of the strand material along the predetermined path upon occurrence of a predetermined condition.

22. A method according to claim 21 further comprising determining lengths of advancing strand material and interrupting continued advancement of strand material along the path upon advancement of a predetermined length of material.

23. A method according to claim 21 further comprising determining the absence of advancing strand material and interrupting continued operation of the electrical drive in the absence of strand material being advanced along the path.

* * * * *